US009773456B2

(12) United States Patent
Kang

(10) Patent No.: US 9,773,456 B2
(45) Date of Patent: Sep. 26, 2017

(54) DATA VOLTAGE COMPENSATION CIRCUIT AND DISPLAY DEVICE INCLUDING THE SAME

(71) Applicant: SAMSUNG DISPLAY CO., LTD., Yongin, Gyeonggi-Do (KR)

(72) Inventor: Hyun-Suk Kang, Asan-si (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 358 days.

(21) Appl. No.: 14/677,157

(22) Filed: Apr. 2, 2015

(65) Prior Publication Data

US 2016/0104429 A1 Apr. 14, 2016

(30) Foreign Application Priority Data

Oct. 8, 2014 (KR) ..... 10-2014-0135594

(51) Int. Cl.
*G09G 3/32* (2016.01)
*G09G 3/3291* (2016.01)

(52) U.S. Cl.
CPC ..... *G09G 3/3291* (2013.01); *G09G 2320/029* (2013.01); *G09G 2320/0223* (2013.01); *G09G 2320/0233* (2013.01); *G09G 2320/0673* (2013.01)

(58) Field of Classification Search
CPC ..... G09G 3/3233; G09G 2320/029; G09G 2320/0673; G09G 3/3291; G09G 2320/0223; G09G 2320/0276
See application file for complete search history.

(56) References Cited

U.S. PATENT DOCUMENTS

2013/0176349 A1 7/2013 Park et al.
2013/0271507 A1 10/2013 Kim et al.
2014/0111402 A1 4/2014 Kim
2014/0139126 A1 5/2014 Yang et al.
2015/0130690 A1* 5/2015 Kim ..... G09G 3/3233 345/78

FOREIGN PATENT DOCUMENTS

KR 10-2013-0081451 A 7/2013
KR 10-2013-0117904 A 10/2013
KR 10-2014-0050268 A 4/2014

* cited by examiner

*Primary Examiner* — Abbas Abdulselam
(74) *Attorney, Agent, or Firm* — Lee & Morse, P.C.

(57) ABSTRACT

A data voltage compensation circuit includes a compensation information provider, a gamma register, and a compensation data voltage provider. The compensation information provider generates a test data voltage based on a test power supply voltage and a test reference voltage, and provides compensation information corresponding to the test data voltage. The gamma register provides a gamma value corresponding to display data. The compensation data voltage provider provides a compensation data voltage based on the gamma value, the compensation information, and a reference voltage. Changes in the reference voltage change a power supply voltage of a display panel.

20 Claims, 9 Drawing Sheets

| ELVDD | VAVC | V203 |
|---|---|---|
| 4.70 | 6.40 | 3.6246 |
| 4.68 | 6.38 | 3.6132 |
| 4.66 | 6.36 | 3.6019 |
| 4.64 | 6.34 | 3.5906 |
| 4.62 | 6.32 | 3.5793 |
| 4.60 | 6.30 | 3.5679 |
| 4.58 | 6.28 | 3.5566 |
| 4.56 | 6.26 | 3.5453 |
| 4.54 | 6.24 | 3.5339 |
| 4.52 | 6.22 | 3.5226 |
| 4.50 | 6.20 | 3.5113 |

| ELVDD | VAVC | V203 | V255 |
|---|---|---|---|
| 4.70 | 6.40 | 3.6246 | 2.2326 |
| 4.68 | 6.38 | 3.6132 | 2.2256 |
| 4.66 | 6.36 | 3.6019 | 2.2186 |
| 4.64 | 6.34 | 3.5906 | 2.2116 |
| 4.62 | 6.32 | 3.5793 | 2.2047 |
| 4.60 | 6.30 | 3.5679 | 2.1977 |
| 4.58 | 6.28 | 3.5566 | 2.1907 |
| 4.56 | 6.26 | 3.5453 | 2.1837 |
| 4.54 | 6.24 | 3.5339 | 2.1767 |
| 4.52 | 6.22 | 3.5226 | 2.1698 |
| 4.50 | 6.20 | 3.5113 | 2.1628 |

DATA VOLTAGE COMPENSATION CIRCUIT AND DISPLAY DEVICE INCLUDING THE SAME

CROSS-REFERENCE TO RELATED APPLICATION

Korean Patent Application No. 10-2014-0135594, filed on Oct. 8, 2014, and entitled, "Data Voltage Compensation Circuit and Display Device Including the Same," is incorporated by reference herein in its entirety.

BACKGROUND

1. Field

One or more embodiments described herein relate to a data voltage compensation circuit and a display device including such a circuit.

2. Discussion of the Related Art

The load of a display panel may change as environmental conditions change. This may produce a change in a power supply voltage. For example, when the load of a display panel increases, the level of the power supply voltage may decrease. A change in power supply voltage may adversely affect performance of the display panel.

SUMMARY

In accordance with one embodiment, a data voltage compensation circuit includes a compensation information provider to generate a test data voltage based on a test power supply voltage and a test reference voltage, and to provide compensation information corresponding to the test data voltage; a gamma register to provide a gamma value corresponding to display data; and a compensation data voltage provider to provide a compensation data voltage based on the gamma value, the compensation information, and a reference voltage, wherein changes in the reference voltage are to change a power supply voltage of a display panel.

The compensation information provider may include a test data voltage provider to provide the test data voltage based on the test power supply voltage and the test reference voltage; and a compensation information generator may provide the compensation information based on the test data voltage.

The test reference voltage may be changed based on the test power supply voltage. The test reference voltage may be increased as the test power supply voltage is increased. A difference between the test power supply voltage and the test reference voltage may be substantially constant. The compensation information may be determined based on a difference value between a normal test data voltage corresponding to the test data and the test data voltage. A value corresponding to the compensation information may be increased as the difference value between the normal test data voltage and the test data voltage is increased.

The compensation information provider may include a compensation information storage area to store the compensation information. The compensation information may be renewed based on a predetermined time interval. The compensation information may be renewed based on a change in an environment condition of the data voltage compensation circuit.

The compensation data voltage provider may include a gamma compensator to provide a compensation gamma value based on the compensation information and the gamma value; and a compensation data voltage provider to provide the compensation data voltage based on the compensation gamma value and the reference voltage. The compensation gamma value may be increased as a value corresponding to the compensation information is increased.

The compensation data voltage provider may include a reference voltage compensator to provide a compensation reference voltage based on the compensation information and the reference voltage; and a voltage compensator to provide the compensation data voltage based on the compensation reference voltage and the gamma value. The compensation reference voltage may be increased as a value corresponding to the compensation information is increased. The compensation information provider may provide the compensation information based on a part test data, and the part test data may be a part of the test data. The part test data may be data corresponding to a center value of the test data.

In accordance with another embodiment, a display device a compensation information provider to generate a test data voltage based on a test power supply voltage and a test reference voltage, and to provide compensation information corresponding to the test data voltage; a gamma register to provide a gamma value corresponding to display data; a compensation data voltage provider to provide a compensation data voltage based on the gamma value, the compensation information, and a reference voltage, wherein the reference voltage is changed by a power supply voltage; and a panel to display an image corresponding to the display data based on the compensation data voltage.

The compensation information provider may include a test data voltage provider to provide the test data voltage based on the test power supply voltage and the test reference voltage; and a compensation information generator to provide the compensation information based on the test data voltage, wherein the test reference voltage is changed by the test power supply voltage. The compensation information may be determined based on a difference value between a normal test data voltage corresponding to the test data and the test data voltage. The compensation information may be renewed based on a predetermined time interval.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
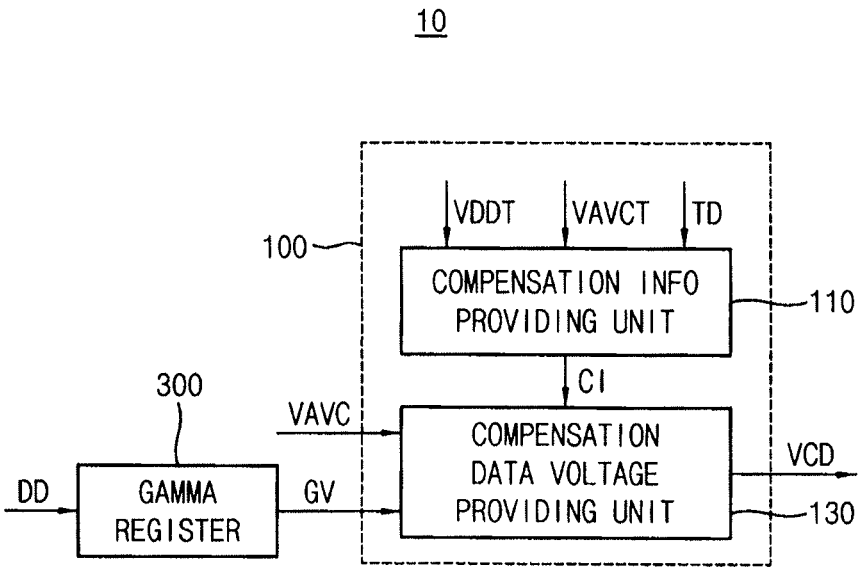
FIG. 1 illustrates an embodiment of a data voltage compensation circuit.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. In the drawings, the dimensions of layers and regions may be exaggerated for clarity of illustration. Like reference numerals refer to like elements throughout.

Figure 2:
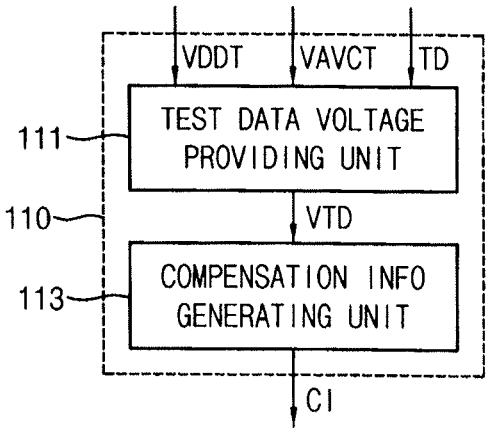
FIG. 2 illustrates an example of a compensation information providing unit.

FIG. 1 illustrates an embodiment of a data voltage compensation circuit 10, and FIG. 2 illustrates an example of a compensation information providing unit 110 in the data voltage compensation circuit 10 of FIG. 1.

Referring to FIGS. 1 and 2, the data voltage compensation circuit 10 includes a compensation unit 100 and a gamma register 300. The compensation unit 100 includes a compensation information providing unit 110 and a compensation data voltage providing unit 130. The compensation info providing unit 110 generates a test data voltage VTD corresponding to a test data TD based on a test power supply voltage VDDT and a test reference voltage VAVCT.

As will be described in FIGS. 5 and 7, the level of a power supply voltage ELVDD of a organic light emitting diode OLED may change as the load of the OLED changes. When the level of the power supply voltage ELVDD of the OLED changes, image quality of the display panel including the OLED may be adversely affected. For example, a current between ends of the OLED may be determined based on a difference between the power supply voltage ELVDD and the data voltage VD. When the level of the power supply voltage ELVDD of the OLED changes, the difference between the power supply voltage ELVDD and the data voltage VD may change. When the difference between the power supply voltage ELVDD and the data voltage VD changes, image quality of the display panel including the OLED may be adversely affected. Also, the load of the OLED may change by environmental surrounding conditions of the OLED. The load of the OLED may change, for example, by use time of the OLED.

Therefore, a reference voltage VAVC may be used so that the data voltage VD changes as the level of the power supply voltage ELVDD of the OLED changes. In one embodiment, the reference voltage VAVC may change as the level of the power supply voltage ELVDD of the OLED changes. The reference voltage VAVC may be used to determine the data voltage VD. In this case, the data voltage VD may changes as the level of the power supply voltage ELVDD of the OLED changes.

For example, the level of the power supply voltage ELVDD of the OLED may change, for example, from 4.7V to 4.5V. When the level of the power supply voltage ELVDD of the OLED changes (e.g., from 4.7V to 4.5V), the reference voltage VAVC may be changed, for example, from 6.4V to 6.2V. When the reference voltage VAVC is changed from 6.4V to 6.2V, the data voltage VD may change. In this example, the reference voltage VAVC corresponding to 4.7V, that is the level of the power supply voltage ELVDD of the OLED, may be 6.4V. The reference voltage VAVC corresponding to 4.5V, that is the level of the power supply voltage ELVDD of the OLED, may be 6.2V. The difference between the power supply voltage ELVDD of the OLED and the reference voltage VAVC corresponding to the power supply voltage ELVDD of the OLED is 1.7V. In other embodiments, the voltages may have different values.

The data voltage VD corresponding to the display data DD may be V0 through V255. When the level of the power supply voltage ELVDD of the OLED is 4.7V and the reference voltage VAVC is 6.4V, the data voltage VD corresponding to V203 may be 3.62V. When the level of the power supply voltage ELVDD of the OLED is 4.6V and the reference voltage VAVC is 6.3V, the data voltage VD corresponding to V203 may be 3.57V.

Even though the reference voltage VAVC is used, the difference between the power supply voltage ELVDD of the OLED and the data voltage VD may not be a constant. For example, when the level of the power supply voltage ELVDD of the OLED is 4.7V and the data voltage VD corresponding to V203 is 3.62V, the difference between the power supply voltage ELVDD of the OLED and the data voltage VD is 1.08V. When the level of the power supply voltage ELVDD of the OLED is 4.6V and the data voltage VD corresponding to V203 is 3.57V, the difference between the power supply voltage ELVDD of the OLED and the data voltage VD is 1.03V. Even though the reference voltage VAVC is used, the difference between the power supply voltage ELVDD of the OLED and the data voltage VD may not be constant.

In one embodiment of the data voltage compensation circuit 10, the test data voltage VTD corresponding to the test data TD may be generated based on the test power supply voltage VDDT and the test reference voltage VAVCT. By providing compensation information CI determined based on the test data voltage VTD, the difference between the power supply voltage ELVDD of the OLED and the data voltage VD may be maintained at a constant value, or at least substantially so. The test power supply voltage VDDT may be a power supply voltage ELVDD of the OLED. The test data voltage VTD corresponding to the test data TD may be generated by changing the test reference voltage VAVCT and the test power supply voltage VDDT. The test reference voltage VAVCT may be changed based on the test power supply voltage VDDT.

For example, the test power supply voltage VDDT may be changed from 4.7V to 4.5V. When the level of the test power supply voltage VDDT changes from 4.7V to 4.5V, the test reference voltage VAVCT may be changed from 6.4V to 6.2V. When the test reference voltage VAVCT changes from 6.4V to 6.2V, the test data voltage VTD may be changed. The test reference voltage VAVCT corresponding to 4.7V, that is the level of the test power supply voltage VDDT, may be 6.4V. The test reference voltage VAVCT corresponding to 4.5V, that is the level of the test power supply voltage VDDT, may be 6.2V. The difference between the test power supply voltage VDDT and the test reference voltage VAVCT corresponding to the test power supply voltage VDDT is 1.7V.

The test data voltage VTD corresponding to the test data TD may be V0 through V255. When the level of the test power supply voltage VDDT is 4.7V and the test reference voltage VAVCT is 6.4V, the test data voltage VTD corresponding to V203 may be 3.62V. When the level of the test power supply voltage VDDT is 4.6V and the test reference voltage VAVCT is 6.3V, the test data voltage VTD corresponding to V203 may be 3.57V. When the level of the test power supply voltage is 4.7V and the test data voltage VTD corresponding to V203 is 3.62V, the difference between the test power supply voltage VDDT and the test data voltage VTD is 1.08V. When the level of the test power supply voltage VDDT is 4.6V and the test data voltage VTD corresponding to V203 is 3.57V, the difference between the test power supply voltage VDDT and the test data voltage VTD is 1.03V. In this example, the difference between the power supply voltage ELVDD of the OLED and the data voltage VD is 1.08V. As a result, normal image quality may be maintained in the display panel.

Therefore, when the power supply voltage ELVDD of the OLED is 4.6V and the data voltage VD corresponding to V203 is 3.57V, the data voltage VD corresponding to V203 may be corrected because the difference between the test power supply voltage VDDT and the test data voltage VTD is 1.03V. In one embodiment, the compensation information CI may be a value corresponding to the difference between 1.08V and 1.03V.

Therefore the compensation information providing unit 110 may generate a test data voltage VTD corresponding to a test data TD based on a test power supply voltage VDDT and a test reference voltage VAVCT. The compensation information providing unit 110 may provide the compensation information CI determined by the test data voltage VTD. The data voltage VD may be compensated by the compensation information CI.

The compensation information providing unit 110 provides compensation information CI determined by the test data voltage VTD. The gamma register 300 provides a gamma value CGV corresponding to a display data DD. The compensation data voltage providing unit 130 provides a compensation data voltage VCD based on the gamma value CGV, the compensation information CI, and a reference voltage VAVC. The reference voltage VAVC is changed by the power supply voltage ELVDD.

For example, the compensation data voltage providing unit 130 may receive the compensation information CI determined by the power supply voltage ELVDD and the gamma value CGV. For example, the difference between the power supply voltage ELVDD of the OLED and the data voltage VD corresponding to V203 may be 1.08V, so that the display panel maintains normal image quality. When the test power supply voltage VDDT is 4.6V and the test data voltage VTD corresponding to V203 is 3.57V, the difference between the test power supply voltage VDDT and the test data voltage VTD is 1.03V. In this case, the power supply voltage ELVDD may be 4.6V and the gamma value CGV may be a value corresponding to V203.

The compensation information providing unit 110 provides the compensation information CI corresponding to the difference between 1.08V and 1.03V to the compensation data voltage providing unit 130. The compensation data voltage providing unit 130 provides a compensation data voltage VCD based on the gamma value CGV, the compensation information CI, and a reference voltage VAVC.

In one embodiment, the compensation information providing unit 110 includes a test data voltage providing unit 111 and a compensation information generating unit 113. The test data voltage providing unit 111 may provide the test data voltage VTD based on the test power supply voltage VDDT and the test reference voltage VAVCT. The compensation information generating unit 113 may provide the compensation information CI based on the test data voltage VTD.

Before the data voltage compensation circuit 10 is normally operated, the compensation information CI corresponding to the test data voltage VTD, that is measured based on the test power supply voltage VDDT and the test reference voltage VAVCT, may be stored in the compensation information generating unit 113. When the data voltage compensation circuit 10 is normally operated, the compensation information providing unit 110 may provide the compensation information CI, that is determined by the power supply voltage ELVDD and the gamma value CGV corresponding to the display data DD. In addition, the compensation information providing unit 110 may provide the compensation information CI, that is determined by the reference voltage VAVC and the gamma value CGV corresponding to the display data DD.

Figure 3:
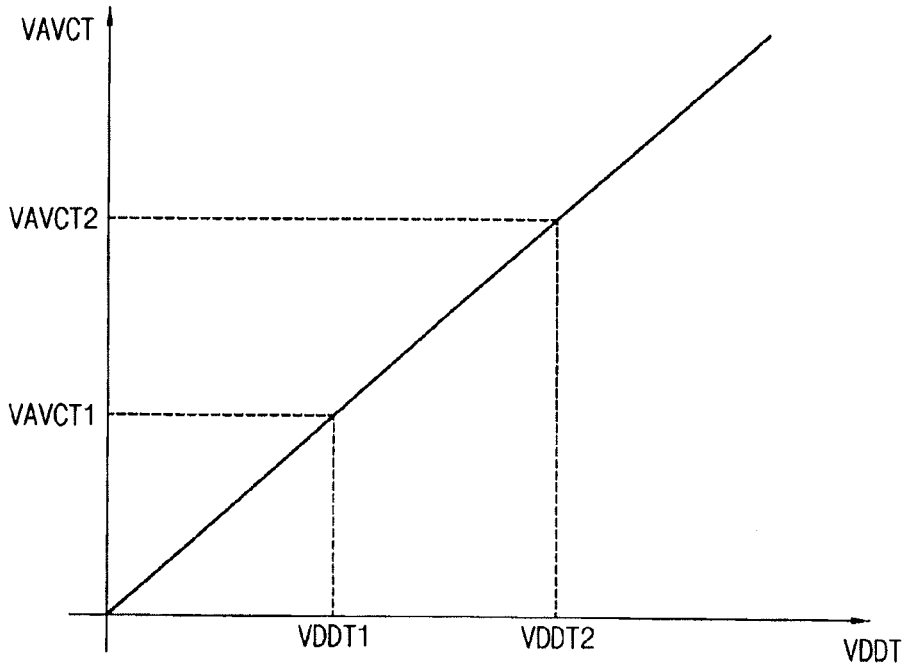
FIG. 3 illustrates an example of changes in a reference voltage.
Figure 4:
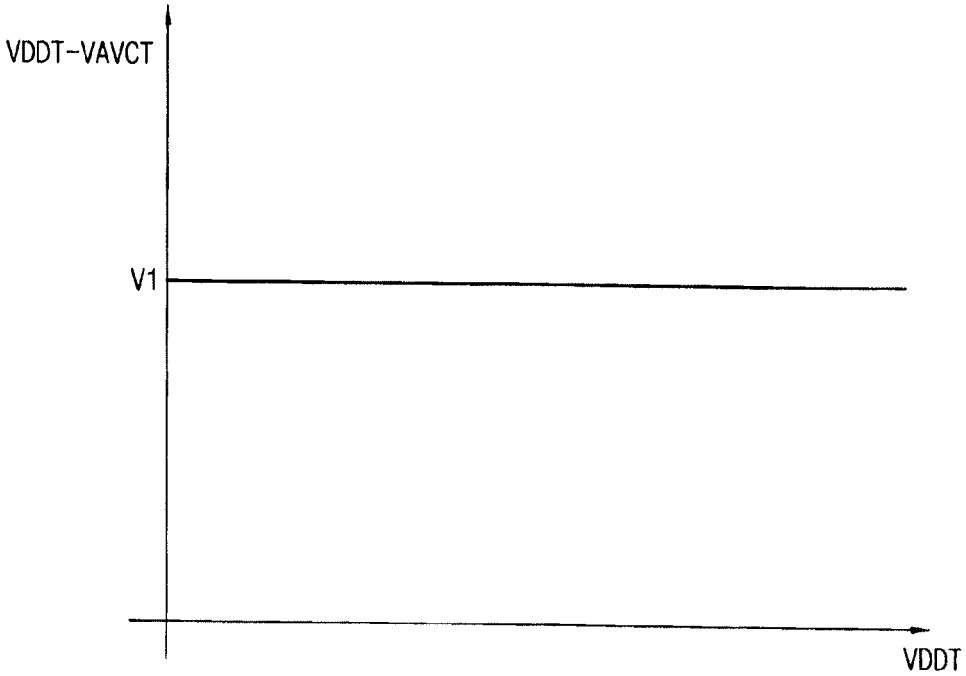
FIG. 4 illustrates an example of a difference between a test power supply voltage and a test reference voltage.

FIG. 3 illustrates an example of a change in a reference voltage according to a test power supply voltage, and FIG. 4 illustrates a difference between a test power supply voltage and a test reference voltage according to the test power supply voltage.

Referring to FIGS. 3 and 4, the test reference voltage VAVCT may be changed by the test power supply voltage VDDT. The test reference voltage VAVCT may be increased as the test power supply voltage VDDT is increased. For example, in case the test power supply voltage VDDT increases from the first test power supply voltage VDDT1 to the second test power supply voltage VDDT2, the test reference voltage VAVCT may be increased from the first test reference voltage VAVCT1 to the second test reference voltage VAVCT2.

In one embodiment, the test reference voltage VAVCT corresponding to the first test power supply voltage VDDT1 may be the first test reference voltage VAVCT1, and the test reference voltage VAVCT corresponding to the second test power supply voltage VDDT2 may be the second test reference voltage VAVCT2. The test reference voltage VAVCT may be decreased as the test power supply voltage VDDT is decreased. For example, in case the test power supply voltage VDDT is decreased from the second test power supply voltage VDDT to the first test power supply voltage VDDT1, the test reference voltage VAVCT may be decreased from the second test reference voltage VAVCT2 to the first test reference voltage VAVCT1.

In one embodiment, the difference between the test power supply voltage VDDT and the test reference voltage VAVCT may be constant. As the power supply voltage ELVDD of the OLED is changed, the reference voltage VAVC may be changed. As the reference voltage VAVC is changed, the data voltage VD may be changed. As a result, as the power supply voltage ELVDD of the OLED is changed, the data voltage VD may be changed. The difference between the power supply voltage ELVDD of the OLED and the reference voltage VAVC may be constant.

The compensation information providing unit 110 may generate a test data voltage VTD corresponding to a test data TD based on a test power supply voltage VDDT and a test reference voltage VAVCT. The compensation information providing unit 110 may provide the compensation information CI determined by the test data voltage VTD. The compensation data voltage providing unit 130 may provide the compensation data voltage VCD using the compensation information CI corresponding to the reference voltage VAVC and the gamma value CGV.

For example, as will be described in FIGS. 5 and 7, the power supply voltage ELVDD of the OLED may be changed from 4.7V to 4.5V. When the power supply voltage ELVDD of the OLED is changed from 4.7V to 4.5V, the reference voltage VAVC may be changed from 6.4V to 6.2V. When the reference voltage VAVC is changed from 6.4V to 6.2V, the data voltage VD may be changed. The reference voltage VAVC corresponding to 4.7V, that is the power supply voltage ELVDD of the OLED, may be 6.4V. The reference voltage VAVC corresponding to 4.5V, that is the power supply voltage ELVDD of the OLED, may be 6.2V. The difference between the power supply voltage ELVDD of the OLED and the reference voltage VAVC corresponding to the power supply voltage ELVDD of the OLED is 1.7V.

The difference between the power supply voltage ELVDD of the OLED and the reference voltage VAVC corresponding to the power supply voltage ELVDD of the OLED may be constant. In this case, the test power supply voltage VDDT, that is provided to the compensation information providing unit 110, may be changed from 4.7V to 4.5V. The test reference voltage VAVCT, that is provided to the compensation information providing unit 110, may be changed from 6.4V to 6.2V.

The compensation information providing unit 110 may generate a test data voltage VTD corresponding to a test data TD based on a test power supply voltage VDDT and a test reference voltage VAVCT. The compensation info providing unit 110 may provide the compensation information CI determined by the test data voltage VTD. In this case, the difference between the test power supply voltage VDDT and the test reference voltage VAVCT may be constant.

Thus, in this embodiment, the data voltage compensation circuit 10 may improve image quality by compensating the data voltage VD based on the compensation information CI determined by the test data voltage VTD.

Figures 5, 6:
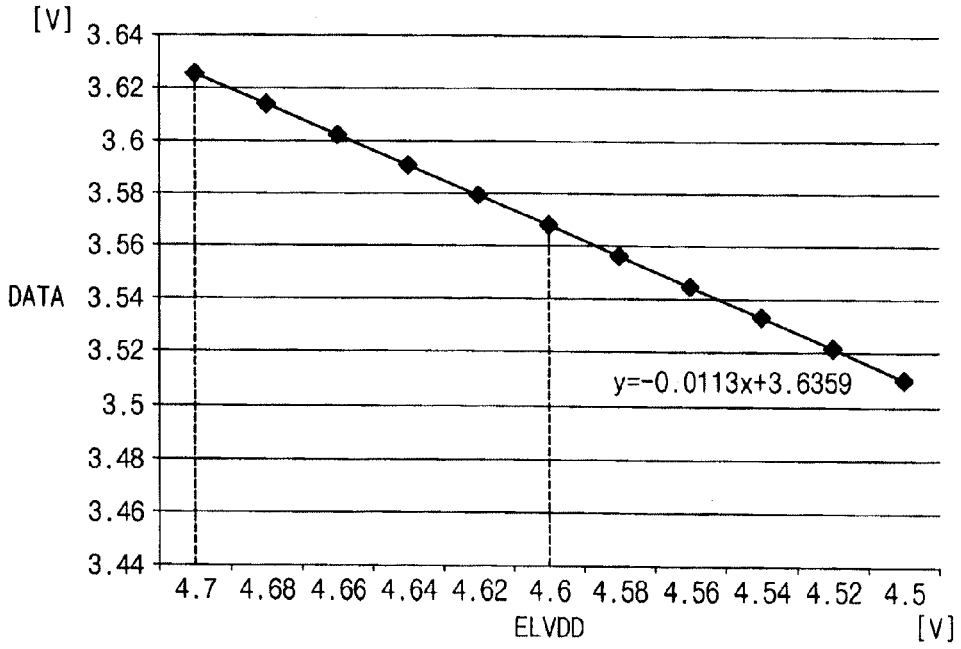
FIG. 5 illustrates an example of a data voltage based on a power supply voltage and a reference voltage.
FIG. 6 illustrates an example of a data voltage based on a power supply voltage.

FIG. 5 illustrates an example of a data voltage according to a power supply voltage and a reference voltage, and FIG. 6 illustrates an example of a data voltage according a power supply voltage.

Referring to FIGS. 5 and 6, the data voltage VD corresponding to the display data DD may be V0 through V255. When the power supply voltage ELVDD of the OLED is 4.7V and the reference voltage VAVC is 6.4V, the data voltage VD corresponding to V203 may be 3.62V. When the power supply voltage ELVDD of the OLED is 4.6V and the reference voltage VAVC is 6.3V, the data voltage VD corresponding to V203 may be 3.57V. To maintain a constant difference between the power supply voltage ELVDD of the OLED and the data voltage VD, even though the reference voltage VAVC is used, the difference between the power supply voltage ELVDD of the OLED and the data voltage VD may not be constant.

For example, when the power supply voltage ELVDD of the OLED is 4.7V and the data voltage VD corresponding to V203 is 3.62V, the difference between the power supply voltage ELVDD of the OLED and the data voltage VD may be 1.08V. When the power supply voltage ELVDD of the OLED is 4.6V and the data voltage VD corresponding to V203 is 3.57V, the difference between the power supply voltage ELVDD of the OLED and the data voltage VD is 1.03V. In this case, the difference between the power supply voltage ELVDD of the OLED and the data voltage VD may not be constant.

In one embodiment, the data voltage compensation circuit 10 may generate the test data voltage VTD corresponding to the test data TD based on the test power supply voltage VDDT and test reference voltage VAVCT. The data voltage compensation circuit 10 may maintain a constant difference between the power supply voltage ELVDD of the OLED and the data voltage VD, by providing the compensation information CI determined by the test data voltage. The test power supply voltage VDDT may be the power supply voltage ELVDD of the OLED. The test data voltage VTD corresponding to the test data TD may be generated by changing the test power supply voltage VDDT and the test reference voltage VAVCT.

Figure 7:
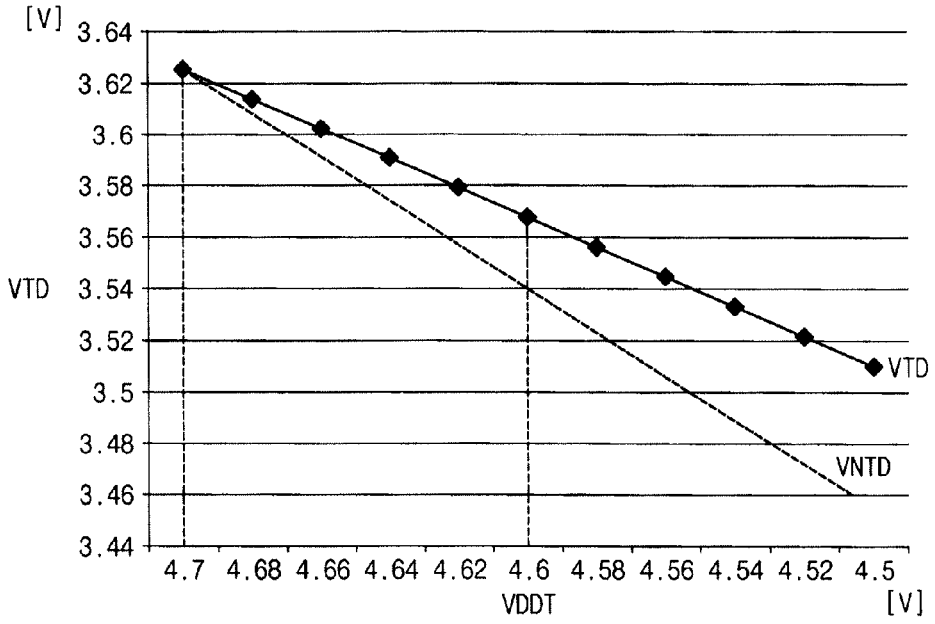
FIG. 7 illustrates an example of compensation information.
Figure 8:
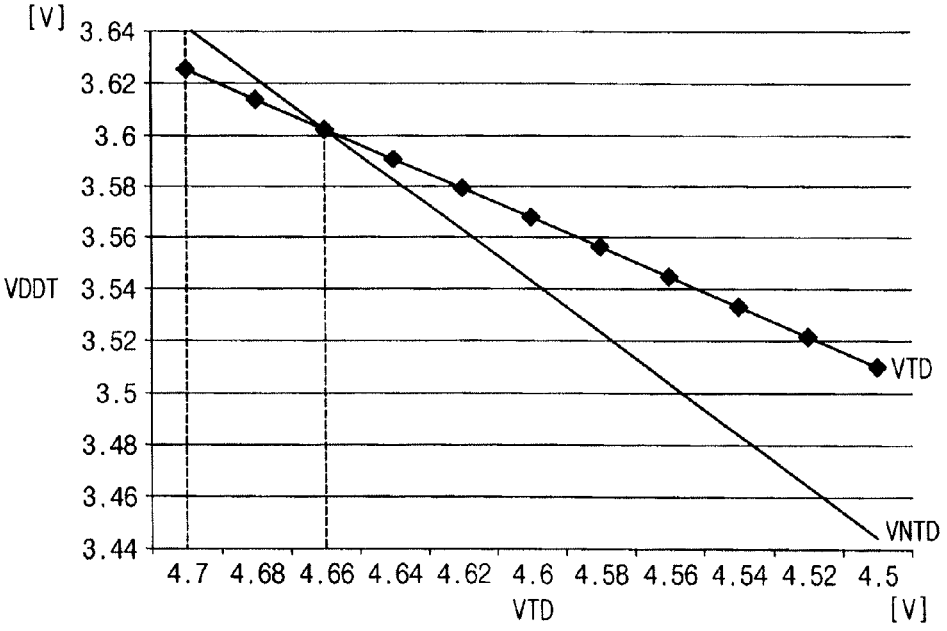
FIG. 8 illustrates another example of compensation information.

FIG. 7 illustrates an example of compensation information used in the data voltage compensation circuit of FIG. 1, and FIG. 8 illustrates another example of compensation information used in the data voltage compensation circuit of FIG. 1.

Referring to FIG. 7, the compensation information CI may be determined based on a difference value between a normal test data voltage VNTD corresponding to the test data TD and the test data voltage VTD. For example, the test power supply voltage VDDT may be a first test power supply voltage VDDT1. The normal test data voltage VNTD may be a first normal test data voltage VNTD1. When the normal test data voltage VNTD is a first normal test data voltage VNTD1, the difference between the first test power supply voltage VDDT1 and the first normal test data voltage VNTD1 may be a first voltage difference. The test power supply voltage VDDT may be a second test power supply voltage VDDT2 that is decreased from the first test power supply voltage VDDT1 by a first voltage. In this case, the normal test data voltage VNTD may be a second normal test data voltage VNTD2 that is decreased from the first normal test data voltage VNTD1 by a first voltage. The difference between the second test power supply voltage VDDT2 and the second normal test data voltage VNTD2 may be the first voltage difference. The difference between the test power supply voltage VDDT and the normal test data voltage VNTD may be constant.

In one embodiment, a value corresponding to the compensation information CI may be increased as the difference value between the normal test data voltage VNTD and the test data voltage VTD is increased. For example, in case the test power supply voltage VDDT is 4.7V, the difference value between the normal test data voltage VNTD and the test data voltage VTD may be 0V. When the power supply voltage ELVDD is 4.7, the value of the corresponding compensation information CI may be 0.

For example, when the test power supply voltage VDDT is 4.6V, the difference value between the normal test data voltage VNTD and the test data voltage VTD may be 0.05V. When the power supply voltage ELVDD is 4.6, the value of the corresponding compensation information CI may be 5. Therefore the value corresponding to the compensation information CI may be increased as the difference value between the normal test data voltage VNTD and the test data voltage VTD is increased.

Referring to FIG. 8, in case the test power supply voltage VDDT is 4.7V, the difference value between the normal test data voltage VNTD and the test data voltage VTD may be 0.02V. When the power supply voltage ELVDD is 4.7V, the compensation data voltage providing unit 130 may provide the compensation data voltage VCD by adding 0.02V to the data voltage VD. In this case, the compensation information CI may be the value corresponding to 0.02V. When the test power supply voltage VDDT is 4.66V, the difference value between the normal test data voltage VNTD and the test data voltage VTD may be 0V. In this case, the compensation information CI may be a value corresponding to 0V.

Figure 9:
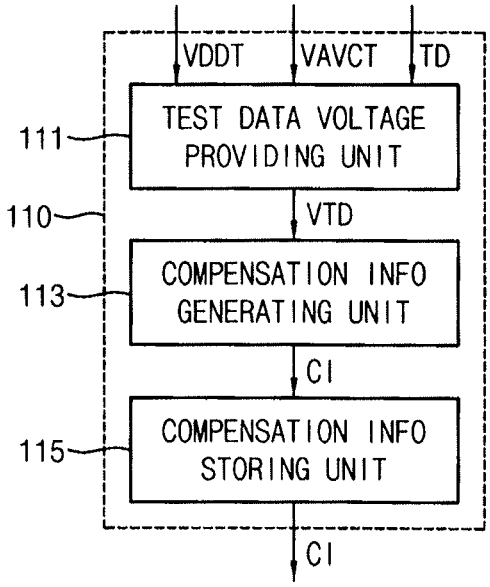
FIG. 9 illustrates another example of a compensation information providing unit.
Figure 10:
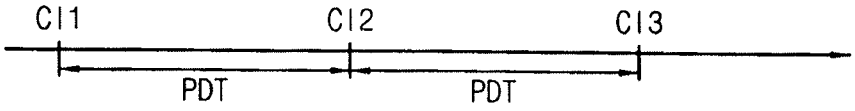
FIG. 10 illustrates an embodiment for renewing compensation information.

FIG. 9 illustrates another example of a compensation information providing unit, which, for example, may be in the data voltage compensation circuit of FIG. 1, and FIG. 10 illustrates an example for renewing compensation information in the data voltage compensation circuit of FIG. 1.

Referring to FIGS. 9 and 10, the compensation information providing unit 110 may include a test data voltage providing unit 111 and a compensation information generating unit 113. The test data voltage providing unit 111 may provide the test data voltage VTD based on the test power supply voltage VDDT and the test reference voltage VAVCT. The compensation information generating unit 113 may provide the compensation information CI based on the test data voltage VTD. The compensation information providing unit 110 may further include a compensation information storing unit 115 that stores the compensation information CI. For example, the compensation information CI stored in the compensation information storing unit may be renewed every predetermined time interval PDT.

For example, in a first time, the compensation information providing unit 110 may generate the first compensation information CI1. The first compensation information CI1 may be stored in the compensation information storing unit 115.

In a second time after the first time, the compensation information providing unit 110 may generate the second compensation information CI2. The second compensation information CI2 may be stored in the compensation information storing unit 115.

In a third time after the second time, the compensation information providing unit 110 may generate the third compensation information CI3. The third compensation information CI may be stored in the compensation info storing unit 115.

In one embodiment, the compensation information CI may be renewed, for example, when a change is detected in an environmental condition of the data voltage compensation circuit 10. For example, the compensation information providing unit may renew the compensation information CI when the position of the display device including the data voltage compensation circuit 10 changes. Additionally, or alternatively, the compensation information providing unit 110 may renew the compensation information CI when the temperature of the display device including the data voltage compensation circuit 10 changes. In other embodiments, the compensation information CI may be renewed when another predetermined condition occurs, e.g., one different from position or temperature including but not limited to age, number of hours of continuous use, or another condition.

Figure 11:
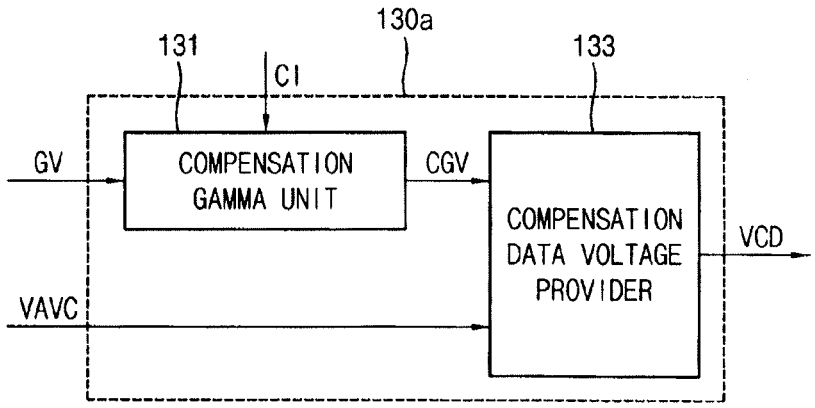
FIG. 11 illustrates an embodiment of a compensation data voltage providing unit.
Figure 12:
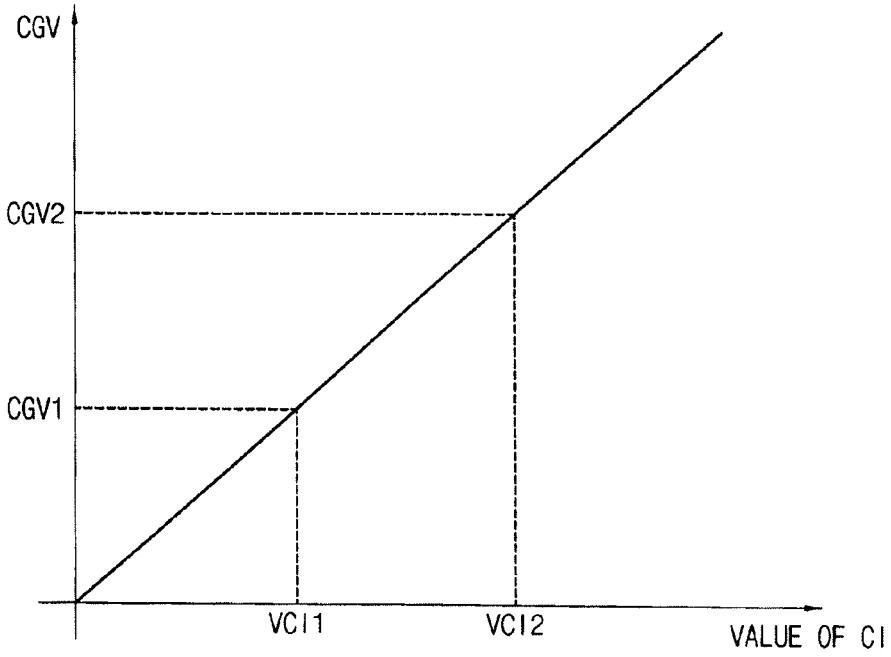
FIG. 12 illustrates an example of how the compensation data voltage providing unit may operate.

FIG. 11 illustrates an example of a compensation data voltage providing unit 130*a*, which, for example, may be in the data voltage compensation circuit of FIG. 1, and FIG. 12 illustrates an example of the operation of the compensation data voltage providing unit of FIG. 11.

Referring to FIGS. 11 and 12, the compensation data voltage providing unit 130*a* may include a compensation gamma unit 131 and a compensation data voltage provider 133. The compensation gamma unit 131 may provide a compensation gamma value CGV based on the compensation information CI and the gamma value CGV. The compensation data voltage provider 133 may provide the compensation data voltage VCD based on the compensation gamma value CGV and the reference voltage VAVC.

In one embodiment, the compensation gamma value CGV may be increased as a value corresponding to the compensation information CI is increased. For example, the value corresponding to the compensation information CI may be increased from the value corresponding to the first compensation information CI1 to the value corresponding to the second compensation information CI2. When the value corresponding to the compensation information CI is increased from the value corresponding to the first compensation information CI1 to the value corresponding to the second compensation information CI2, the compensation gamma value CGV may be increased from the first compensation gamma value CGV to the second compensation gamma value CGV.

The compensation information CI may be used to compensate the gamma value CGV. The gamma value CGV may be controlled to control the compensation data voltage VCD. For example, to increase the compensation data voltage VCD, the compensation gamma value CGV, that is generated by increasing the gamma value CGV, may be used. The compensation data voltage VCD may be provided using the compensation gamma value CGV and the reference voltage VAVC. In one embodiment, the data voltage compensation circuit 10 may improve image quality by compensating the data voltage VD based on the compensation information CI determined by the test data voltage VTD.

Figure 13:
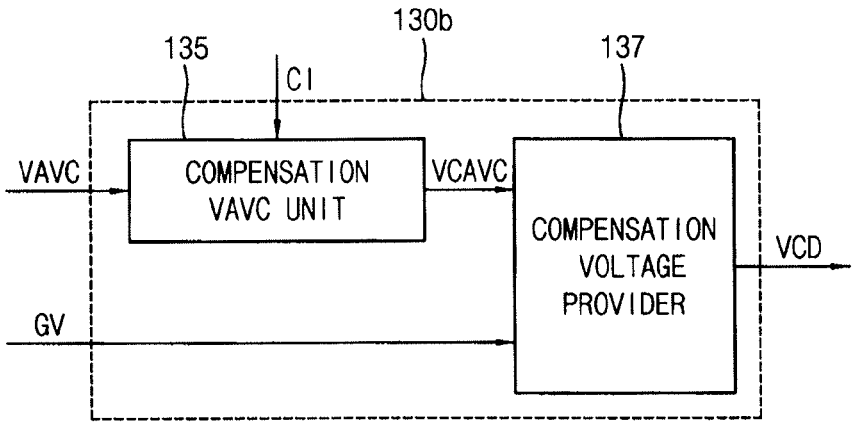
FIG. 13 illustrates another example of a compensation data voltage providing unit.
Figure 14:
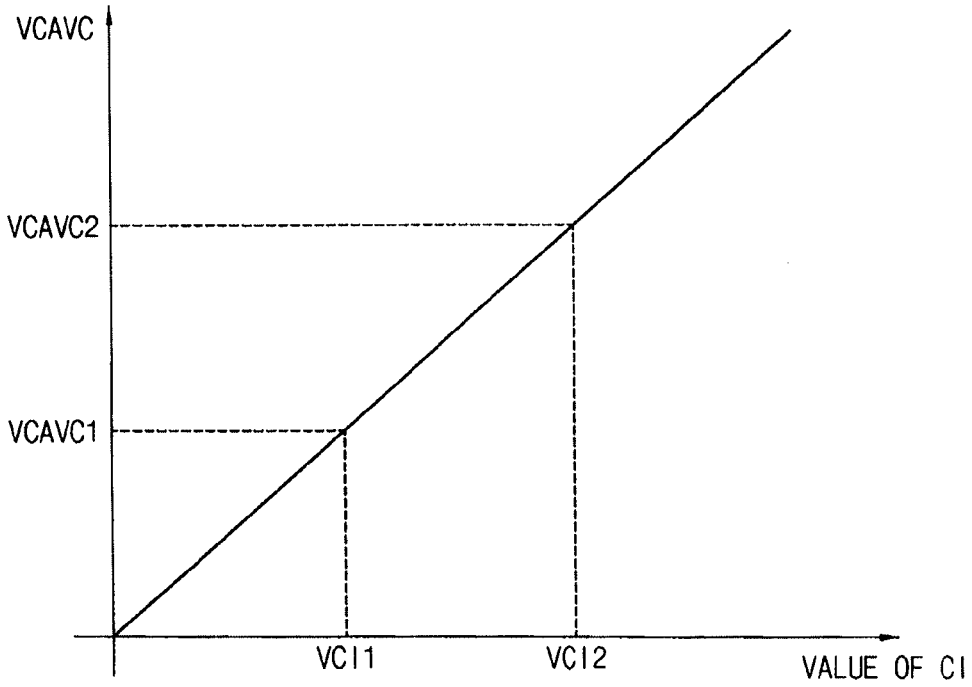
FIG. 14 illustrates an example of how the compensation data voltage providing unit of FIG. 13 may operate.

FIG. 13 illustrates another example of a compensation data voltage providing unit 130*b*, which, for example, may be in the data voltage compensation circuit of FIG. 1, and FIG. 14 illustrates an example of the operation of the compensation data voltage providing unit of FIG. 13.

Referring to FIGS. 13 and 14, the compensation data voltage providing unit 130*b* includes a compensation reference voltage unit 135 and a compensation voltage provider 137. The compensation reference voltage unit 135 may provide a compensation reference voltage VCAVC based on the compensation information CI and the reference voltage VAVC. The compensation voltage provider 137 may provide the compensation data voltage VCD based on the compensation reference voltage VCAVC and the gamma value CGV.

In one embodiment, the compensation reference voltage VCAVC may be increased as a value corresponding to the compensation information CI is increased. For example, the value corresponding to the compensation information CI may be increased from the value corresponding to the first compensation information CI1 to the value corresponding to the second compensation information CI2. When the value corresponding to the compensation information CI is increased from the value corresponding to the first compensation information CI1 to the value corresponding to the second compensation information CI2, the reference voltage VAVC may be increased from the first reference voltage VAVC1 to the second reference voltage VAVC2.

The compensation information CI may be used to compensate the reference voltage VAVC. The reference voltage VAVC may be controlled to control the compensation data voltage VCD. For example, to increase the compensation data voltage VCD, the compensation reference voltage VCAVC generated by increasing the reference voltage VAVC may be used. The compensation data voltage VCD may be provided using the gamma value CGV and the compensation reference voltage VCAVC.

Figures 15, 16:
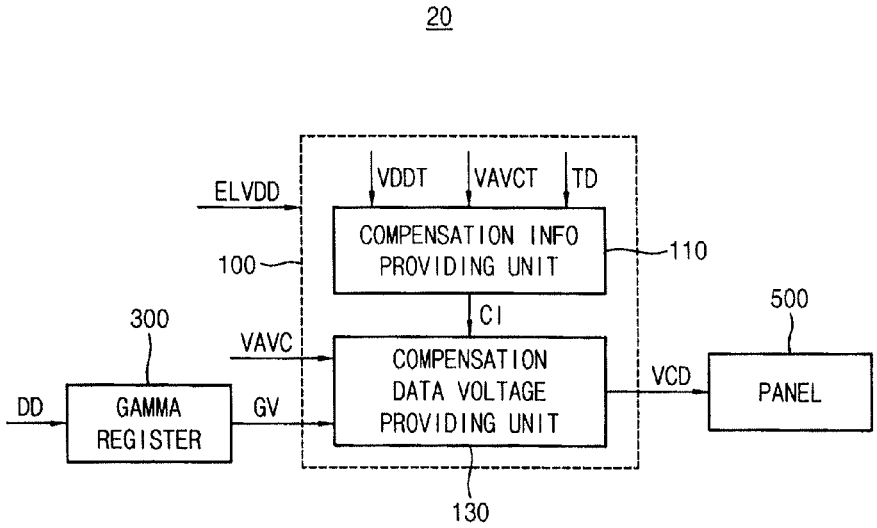
FIG. 15 illustrates another embodiment of a data voltage compensation circuit.
FIG. 16 illustrates an embodiment of a display device.

FIG. 15 illustrates an embodiment of a data voltage compensation circuit. Referring to FIG. 15, the compensation info providing unit 110 may provide the compensation information CI based on a part test data TD. The part test data TD may be a part of the test data TD. Storing the compensation information CI for all test data TD to the compensation info storing unit 115 may be a waste of the resource. Therefore, the compensation information CI may be generated using the part test data TD that is a part of the test data TD.

The compensation information CI for the part test data TD may be stored in the compensation info storing unit 115. In one embodiment, the part test data TD may be a data corresponding to a center value of the test data TD. For example, the data voltage VD corresponding to the display data DD may be V0 through V255. In this case, the part test data TD may be the test data TD corresponding to V127.

FIG. 16 illustrates an embodiment of a display device 20. Referring to FIGS. 2 and 16, a display device 20 includes a compensation information providing unit 110, a gamma register 300, a compensation data voltage providing unit 130, and a panel 500. The compensation information providing unit 110 generates a test data voltage VTD corresponding to a test data TD based on a test power supply voltage VDDT and a test reference voltage VAVCT. The compensation information providing unit 110 provides compensation information CI that is determined by the test data voltage VTD.

The gamma register 300 provides a gamma value CGV corresponding to a display data DD. The compensation data voltage providing unit 130 provides a compensation data voltage VCD based on the gamma value CGV, the compensation information CI, and a reference voltage VAVC. The reference voltage VAVC is changed by a power supply voltage ELVDD.

The panel 500 displays an image corresponding to the display data DD based on the compensation data voltage VCD. The compensation information providing unit 110 may include a test data voltage providing unit 111 and a compensation info generating unit 113. The test data voltage providing unit 111 may provide the test data voltage VTD based on the test power supply voltage VDDT and the test reference voltage VAVCT. The compensation information generating unit 113 may provide the compensation information CI based on the test data voltage VTD. The test reference voltage VAVCT may be changed by the test power supply voltage VDDT. The test reference voltage VAVCT may be changed by the test power supply voltage VDDT.

In one embodiment, the compensation information CI may be determined based on a difference value between a normal test data voltage VNTD corresponding to the test data TD and the test data voltage VTD. The compensation information CI may be renewed, for example, every predetermined time interval PDT and/or upon the occurrence of a predetermined condition, which may or may not be periodic. In one embodiment, the data voltage compensation circuit 10 may improve image quality by compensating the data voltage VD based on the compensation information CI determined by the test data voltage VTD.

Figure 17:
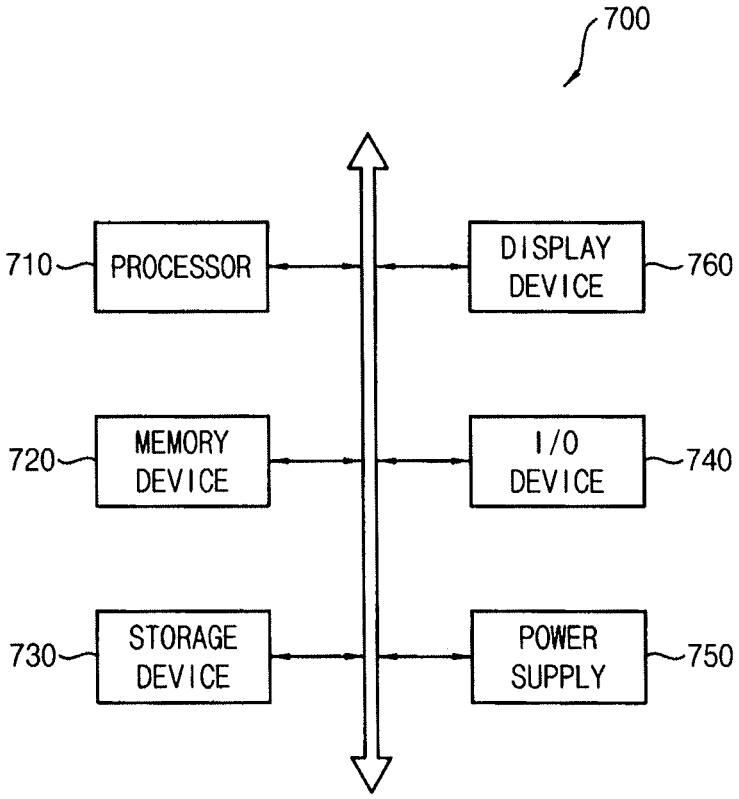
FIG. 17 illustrates an embodiment of a mobile device.

FIG. 17 illustrates an embodiment of a mobile device 700 which includes a processor 710, a memory device 720, a storage device 730, an input/output (I/O) device 740, a power supply 750, and an electroluminescent display device 760. Additionally, the mobile device 700 may include a plurality of ports for communicating a video card, sound card, memory card, universal serial bus (USB) device, or other electronic system.

The processor 710 may perform various computing functions or tasks. The processor 710 may be, for example, a microprocessor, a central processing unit (CPU), logic implemented in hardware, software, or both, or another type processor structure or arrangement. The processor 710 may be connected to other components via an address bus, a control bus, or a data bus. For example, the processor 710 may be coupled to an extended bus such as a peripheral component interconnection (PCI) bus.

The memory device 720 may store data for operations of the mobile device 700. For example, the memory device 720 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano-floating gate memory (NFGM) device, a polymer random access memory (PoRAM) device, a magnetic random access memory (MRAM) device, a ferroelectric random access memory (FRAM) device, and/or at least one volatile memory device such as a dynamic random access memory (DRAM) device, a static random access memory (SRAM) device, a mobile dynamic random access memory (mobile DRAM) device, etc.

The storage device 730 may be, for example, a solid state drive (SSD) device, a hard disk drive (HDD) device, a CD-ROM device, etc. The I/O device 740 may be, for example, an input device such as a keyboard, a keypad, a mouse, a touch screen, and/or an output device such as a printer, a speaker, etc. The power supply 750 may supply power for operating the mobile device 700. The electroluminescent display device 760 may communicate with other components via the buses or other communication links.

The present embodiments may be applied to any mobile device or any computing device. For example, the present embodiments may be applied to a cellular phone, a smart phone, a tablet computer, a personal digital assistant (PDA), a portable multimedia player (PMP), a digital camera, a music player, a portable game console, a navigation system, a video phone, a personal computer (PC), a server computer, a workstation, a tablet computer, a laptop computer, etc.

By way of summation and review, the load of a display panel may change as environmental conditions change. This may produce a change in a power supply voltage. For example, when the load of a display panel increases, the level of the power supply voltage may decrease. A change in power supply voltage may adversely affect performance of the display panel.

In accordance with one or more of the aforementioned embodiments, a data voltage compensation circuit includes a compensation information providing unit, a gamma register, and a compensation data voltage providing unit. The compensation information providing unit provides compensation information determined by the test data voltage. The compensation data voltage providing unit provides a compensation data voltage based on the gamma value, the compensation information, and a reference voltage. The data voltage compensation circuit may compensate, for example, for changes in environmental or other conditions and, thus, improve image quality by compensating the data voltage based on the compensation information determined by the test data voltage.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the inventive technology. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A data voltage compensation circuit, comprising:

a compensation information provider to generate a test data voltage based on a test power supply voltage and a test reference voltage, and to provide compensation information corresponding to the test data voltage;

a gamma register to provide a gamma value corresponding to display data; and a compensation data voltage provider to provide a compensation data voltage based on the gamma value, the compensation information, and a reference voltage, wherein changes in the reference voltage are to change a power supply voltage of a display panel.

2. The data voltage compensation circuit as claimed in claim 1, wherein the compensation information provider includes:

a test data voltage provider to provide the test data voltage based on the test power supply voltage and the test reference voltage; and a compensation information generator to provide the compensation information based on the test data voltage.

3. The data voltage compensation circuit as claimed in claim 2, wherein the test reference voltage is changed based on the test power supply voltage.

4. The data voltage compensation circuit as claimed in claim 3, wherein the test reference voltage is increased as the test power supply voltage is increased.

5. The data voltage compensation circuit as claimed in claim 3, wherein a difference between the test power supply voltage and the test reference voltage is substantially constant.

6. The data voltage compensation circuit as claimed in claim 2, wherein the compensation information is determined based on a difference value between a normal test data voltage corresponding to the test data and the test data voltage.

7. The data voltage compensation circuit as claimed in claim 6, wherein a value corresponding to the compensation information is increased as the difference value between the normal test data voltage and the test data voltage is increased.

8. The data voltage compensation circuit as claimed in claim 2, wherein the compensation information provider includes a compensation information storage area to store the compensation information.

9. The data voltage compensation circuit as claimed in claim 8, wherein the compensation information is renewed based on a predetermined time interval.

10. The data voltage compensation circuit as claimed in claim 8, wherein the compensation information is renewed based on a change in an environment condition of the data voltage compensation circuit.

11. The data voltage compensation circuit as claimed in claim 1, wherein the compensation data voltage provider includes:

a gamma compensator to provide a compensation gamma value based on the compensation information and the gamma value; and a compensation data voltage provider to provide the compensation data voltage based on the compensation gamma value and the reference voltage.

12. The data voltage compensation circuit as claimed in claim 11, wherein the compensation gamma value is increased as a value corresponding to the compensation information is increased.

13. The data voltage compensation circuit as claimed in claim 1, wherein the compensation data voltage provider includes:

a reference voltage compensator to provide a compensation reference voltage based on the compensation information and the reference voltage; and a voltage compensator to provide the compensation data voltage based on the compensation reference voltage and the gamma value.

14. The data voltage compensation circuit as claimed in claim 13, wherein the compensation reference voltage is increased as a value corresponding to the compensation information is increased.

15. The data voltage compensation circuit as claimed in claim 1, wherein the compensation information provider is to provide the compensation information based on a part test data, and wherein the part test data is a part of the test data.

16. The data voltage compensation circuit as claimed in claim 15, wherein the part test data is data corresponding to a center value of the test data.

17. The data voltage compensation circuit as claimed in claim 1, wherein a difference between the power supply voltage of the display panel and the compensation data voltage is maintained at a substantially constant value.

18. A display device, comprising:

a compensation information provider to generate a test data voltage based on a test power supply voltage and a test reference voltage, and to provide compensation information corresponding to the test data voltage;

a gamma register to provide a gamma value corresponding to display data;

a compensation data voltage provider to provide a compensation data voltage based on the gamma value, the compensation information, and a reference voltage, wherein the reference voltage is changed by a power supply voltage; and a panel to display an image corresponding to the display data based on the compensation data voltage.

19. The display device as claimed in claim 18, wherein the compensation information provider includes:

a test data voltage provider to provide the test data voltage based on the test power supply voltage and the test reference voltage; and a compensation information generator to provide the compensation information based on the test data voltage, wherein the test reference voltage is changed by the test power supply voltage.

20. The display device as claimed in claim 18, wherein the compensation information is determined based on a difference value between a normal test data voltage corresponding to the test data and the test data voltage.

* * * * *